US012534959B2

(12) United States Patent
Rivera et al.

(10) Patent No.: US 12,534,959 B2
(45) Date of Patent: Jan. 27, 2026

(54) TOP DRIVE WITH DRAG CHAIN

(71) Applicant: Nabors Drilling Technologies USA, Inc., Houston, TX (US)

(72) Inventors: Camilo Rivera, Spring, TX (US); Shubhangi Dalavi, Spring, TX (US); James Cooper, Spring, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 0 days.

(21) Appl. No.: 18/742,585

(22) Filed: Jun. 13, 2024

(65) Prior Publication Data

US 2024/0418040 A1 Dec. 19, 2024

Related U.S. Application Data

(60) Provisional application No. 63/508,336, filed on Jun. 15, 2023.

(51) Int. Cl.
*E21B 3/02* (2006.01)

(52) U.S. Cl.
CPC ..... *E21B 3/022* (2020.05)

(58) Field of Classification Search
CPC ..... E21B 3/022
See application file for complete search history.

(56) References Cited

U.S. PATENT DOCUMENTS 6,860,337 B1 * 3/2005 Orr ..... E21B 15/00 173/27
7,401,664 B2 7/2008 Wells et al.
7,748,445 B2 7/2010 Wells et al.
7,784,535 B2 8/2010 Wells et al.
7,784,565 B2 8/2010 Wells et al.
2005/0274508 A1 * 12/2005 Folk ..... E21B 3/022 166/77.52
2010/0065336 A1 * 3/2010 Wells ..... E21B 19/16 175/220
2013/0112395 A1 * 5/2013 Story ..... E21B 3/022 166/77.52
2016/0290076 A1 * 10/2016 Francis ..... E21B 19/22
2018/0179833 A1 * 6/2018 Richardson ..... E21B 19/06
2020/0040673 A1 * 2/2020 Donnally ..... B25J 15/0042

FOREIGN PATENT DOCUMENTS

EP 2166193 B1 2/2012
WO 2009001134 A2 12/2008

* cited by examiner

*Primary Examiner* — Shane Bomar
(74) *Attorney, Agent, or Firm* — Abel Schillinger, LLP

(57) ABSTRACT

A top drive that can include a stationary portion, a rotary portion rotationally coupled to the stationary portion, the rotary portion being configured to rotate about a center axis, a drag chain with a first end coupled to the stationary portion and a second end coupled to the rotary portion, a first circular path with a first radius relative to the center axis, and a second circular path with a second radius relative to the center axis, wherein the first radius is different from the second radius, wherein the drag chain comprises a first portion that is disposed along the first circular path and a second portion that is disposed along the second circular path, and wherein a length of the first portion along the first circular path increases or decreases as the rotary portion rotates relative to the stationary portion.

9 Claims, 13 Drawing Sheets

TOP DRIVE WITH DRAG CHAIN

CROSS-REFERENCE TO RELATED APPLICATION(S)

This application claims priority under 35 U.S.C. § 119 (c) to U.S. Provisional Application No. 63/508,336, entitled "TOP DRIVE WITH DRAG CHAIN," by Camilo RIVERA et al., filed Jun. 15, 2023, which is assigned to the current assignee hereof and incorporated herein by reference in its entirety.

FIELD OF THE DISCLOSURE

The present invention relates, in general, to the field of drilling and processing of wells. More particularly, present embodiments relate to a system and method for manipulating tubulars with a top drive during subterranean operations.

SUMMARY

This summary is provided to introduce a selection of concepts that are further described below in the detailed description. This summary is not intended to identify indispensable features of the claimed subject matter, nor is it intended for use as an aid in limiting the scope of the claimed subject matter.

One general aspect includes a top drive for supporting a subterranean operation. The top drive also includes a stationary portion; a rotary portion rotationally coupled to the stationary portion, the rotary portion being configured to rotate about a rotational axis; a drag chain with a first end coupled to the stationary portion and a second end coupled to the rotary portion; a first circular path with a first radius relative to the rotational axis; and a second circular path with a second radius relative to the rotational axis, where the first radius is different from the second radius, where the drag chain may include a first portion that is disposed along the first circular path and a second portion that is disposed along the second circular path, and where a first arc length of the first portion along the first circular path increases or decreases as the rotary portion rotates relative to the stationary portion.

One general aspect includes a top drive for supporting a subterranean operation. The top drive also includes a stationary portion; a rotary portion rotationally coupled to the stationary portion, the rotary portion being configured to rotate about a rotational axis; one or more cables with a first end coupled to the stationary portion and a second end coupled to the rotary portion; and an excess length of the one or more cables disposed in a circular channel that at least partially surrounds the rotational axis, where the excess length of the one or more cables allows rotation of the rotary portion relative to the stationary portion while the one or more cables remain coupled between the rotary portion and the stationary portion.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about", "approximately", "generally", or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

Figure 1:
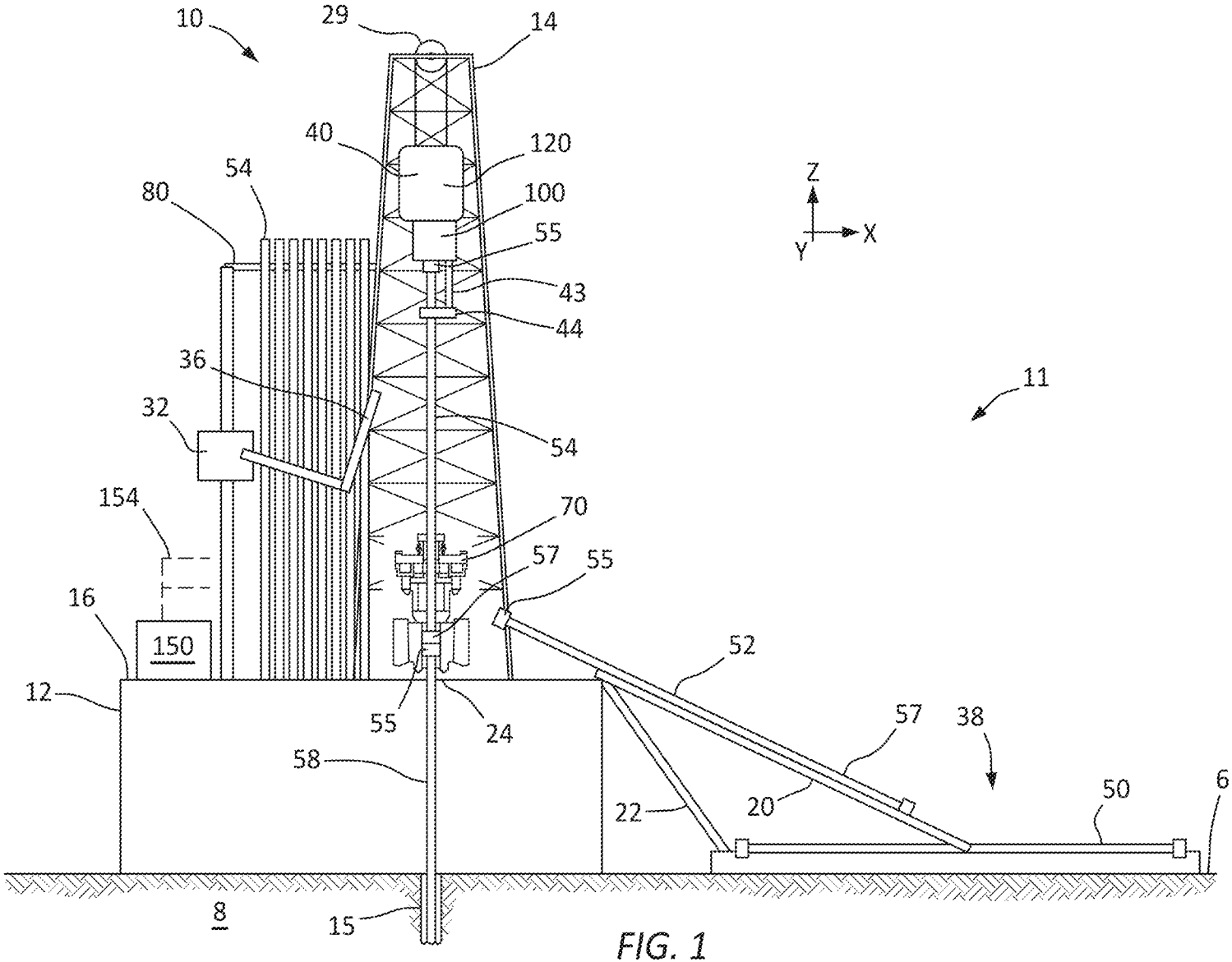
FIG. 1 is a representative functional block diagram of a system with a top drive raised to a height to add or remove a tubular from a tubular string, in accordance with certain embodiments.

FIG. 1 is a representative functional block diagram of a rig 10 at a rig site 11 for managing tubulars to run a tubular string 58 into or out of the wellbore 15 formed through the surface 6 and into the subterranean formation 8. Rig 10 can include a platform 12 with a derrick 14 extending from a rig floor 16. The rig 10 can include a horizontal storage area 38, pipe handlers (e.g., pipe handler 32), an iron roughneck 70, and a vertical tubular storage area 80 at the rig site 11. The derrick 14 can provide structural support for the top drive 40 and a crown block 29. The crown block 29 can be used to raise and lower the top drive 40 along a vertical guide rails 18 (see FIG. 4) fixedly coupled to the derrick 14. The top drive 40 can include a stationary portion 120 and a rotary portion 100. The stationary portion 120 is slidably coupled to the guide rails 18 of the derrick 14 and rotationally coupled to the rotary portion 100.

Links 43 can couple an elevator 44 to the rotary portion 100 to facilitate moving tubular segments from a catwalk 20 (or other pipe handler, mousehole, etc.) to well center 24 for connection to a stump (i.e., portion of tubular string 58 protruding above the rig floor 16) at the well center 24. The links 43 can be rotated about a rotational axis to align the links 43 with tubulars 52, 54 at various azimuthal positions relative to the rotational axis 82 of the rotary portion 100 (which can also be referred to as the center axis 82 of the rotary portion 100). In a particular example, the links 43 can be rotated about the rotational axis 82 to align the links 43 and the elevator 44 with the tubular 52 on the catwalk 20. In a particular example, the links 43 can be rotated about the rotational axis 82 to align the links 43 and the elevator 44 with a mousehole (not shown) or with another pipe handler (e.g., pipe handler 32) to collect or deliver a tubular 52, 54.

For tripping in, the tubular string 58 is run into the wellbore 15 by successively adding additional tubulars 54 to the top end (i.e., the stump) of the tubular string 58 to further extend the tubular string 58 into the wellbore 15. Therefore, tubulars 50 positioned in a horizontal storage area 38 can be presented to the rig floor 16 via a catwalk 20 as it moves along a V-door ramp 22 (e.g., tubular 52). It should be understood that any other tubular manipulation systems (such as a pipe handler 32 with an articulating arm 36) can be used to deliver tubulars from a horizontal tubular storage area 38 or vertical tubular storage area 80 to the rig floor 16 so the top drive 40 (and possibly the elevator 44) can engage the tubular 52, 54 and move it to well center 24 (or a mousehole). Therefore, this disclosure is not limited to the catwalk type pipe handler.

It should be understood that the rotary portion 100 can include a casing running tool with links 43 and an elevator 44 for running casing. In each configuration, the rotary portion 100 is configured to rotate as needed about the rotational axis 82 to position the elevator 44 at the desired azimuthal position relative to the rotational axis 82. The desired azimuthal position can be to engage the elevator 44 with a tubular 52, 54, or to prevent interference of the elevator 44 with a current rig activity that does not require the elevator 44 and needs the elevator 44 to be moved away from the rig activity.

For tripping out, the tubular string 58 is run out of the wellbore 15 by successively removing tubulars 54 from the top end of the tubular string 58 to further retract the tubular string 58 from the wellbore 15. These tubulars segments 54 removed from the tubular string 58 can be moved away from the well center 24 and stored in a horizontal tubular storage area 38 or vertical tubular storage area 80 or removed from the rig site 11.

FIG. 1 shows a tubular 54 that has been moved from the tubular location in the horizontal storage area 38 (e.g., tubular 50), up the catwalk 20 at tubular location on the catwalk 20 (e.g., tubular 52), and to a vertically oriented tubular location at well center 24 (or a mousehole). The tubular 54 has been coupled to a quill 42 at its box end 55 and the pin end 57 of the tubular 54 has been connected to the box end 55 of the tubular string 58.

A rig controller 150 can include one or more processing units communicatively coupled, via a network 154 to the top drive 40. One or more of the processing units can be local to or remotely located from the top drive 40. The rig controller 150 can be communicatively coupled to sensors in the rotary portion 100 and the stationary portion 120 of the top drive 40.

It should be noted that the X-Y-Z coordinate axes are indicated in FIGS. 1, 2, 7, and 9-11C, where the X-Y-Z coordinate axes are relative to the rig floor 16. The rig floor 16 forms an X-Y plane with the Z axis being substantially perpendicular with the rig floor 16. As used herein, "horizontal," "horizontal position," or "horizontal orientation" refers to a position that is substantially parallel with the X-Y plane. As used herein, "vertical," "vertical position," or "vertical orientation" refers to a position that is substantially perpendicular relative to the X-Y plane or substantially parallel with the Z axis.

Figure 2:
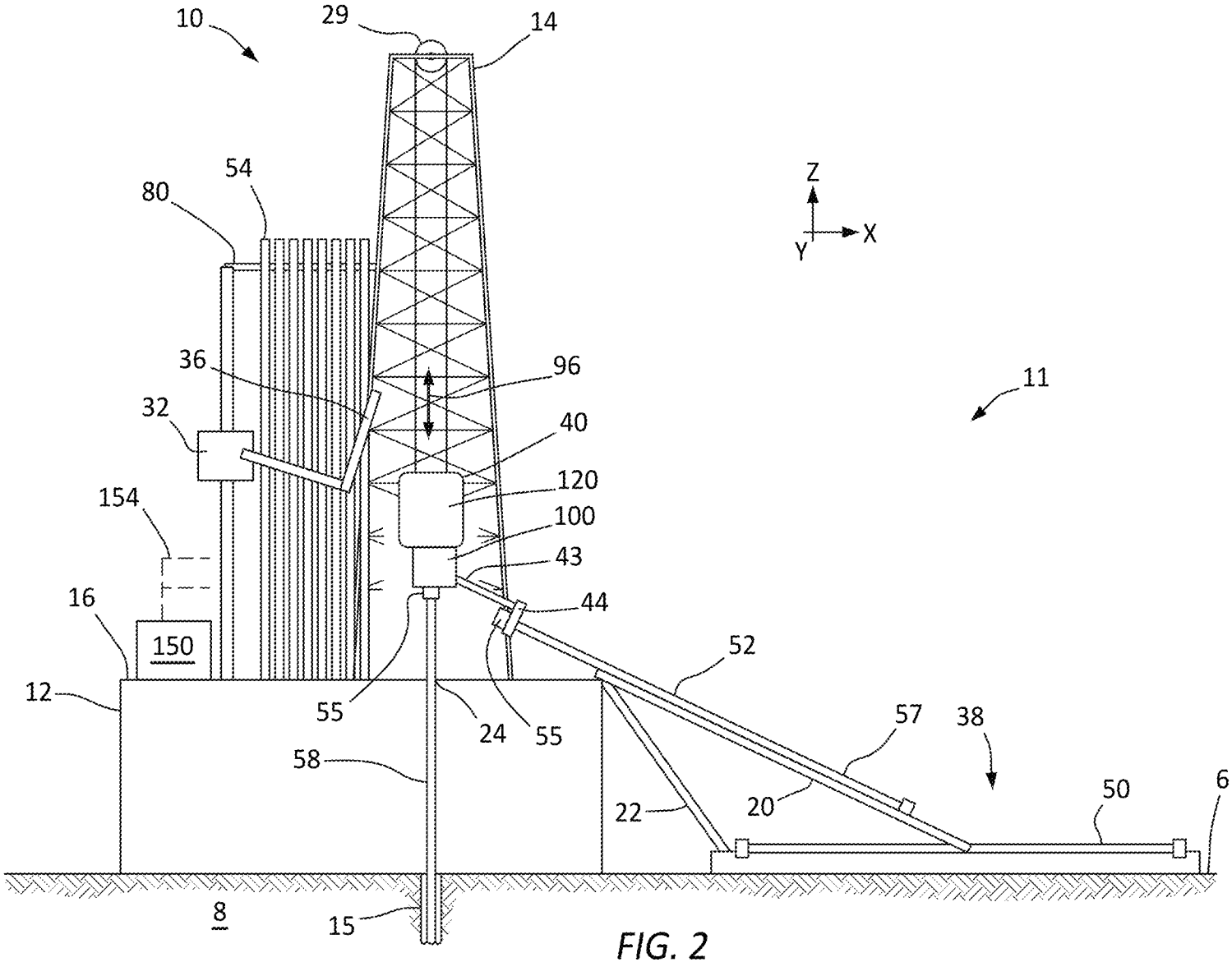
FIG. 2 is a representative functional block diagram of a system with a top drive lowered to a height to collect a tubular from or deliver a tubular to a catwalk, in accordance with certain embodiments.

FIG. 2 shows the top drive 40 lowered (arrows 96) to extend the tubular string 58 further into the wellbore 15. As the top drive 40 is being lowered, the links 43 of the rotary portion 100 can be rotated to a position where the elevator 44 can be secured to the top (e.g., box end 55) of the next tubular 52 when the top drive 40 is at the desired lower position.

Figure 3:
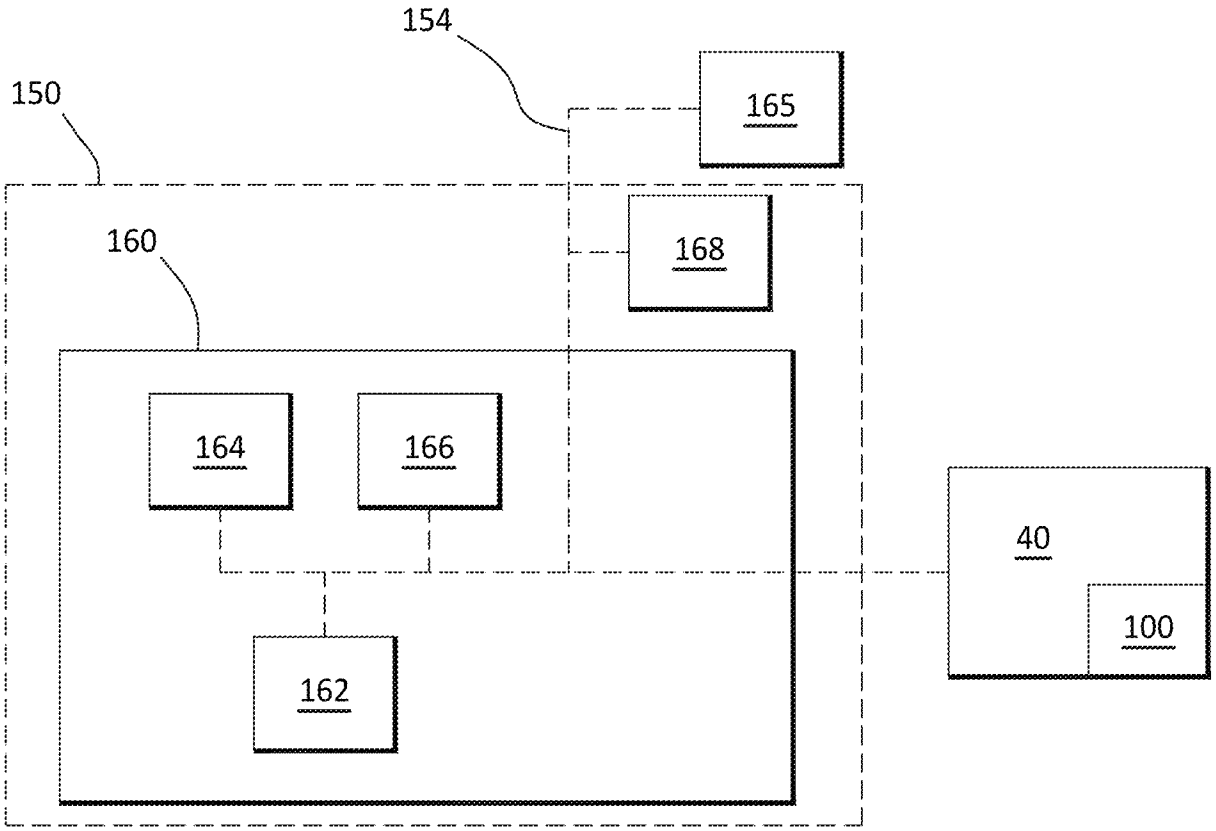
FIG. 3 is a representative functional block diagram of a rig controller for controlling a top drive, in accordance with certain embodiments.

Referring to FIG. 3, a rig controller 150 can include one or more local or remote processing units 160 that can be locally or remotely positioned with the top drive 40. Each processing unit 160 can include one or more processors 162 (e.g., microprocessors, programmable logic arrays, programmable logic devices, etc.), non-transitory memory storage devices 164, peripheral interface 166, human machine interface (HMI) device(s) 168, and possibly a remote telemetry interface 165 for internet communication or satellite network communication. The HMI devices 168 can include a touchscreen, a laptop, a desktop computer, a workstation, or wearables (e.g., smart phone, tablet, etc.). These components of the rig controller 150 can be communicatively coupled together via one or more networks 154, which can be wired or wireless networks.

The processors 162 can be configured to read instructions from one or more non-transitory memory storage devices 164 and execute those instructions to perform any of the operations described in this disclosure. A peripheral interface 166 can be used by the rig controller 150 to receive sensor data from around the rig which can collect data on the top drive 40 and its rotary portion 100. The peripheral interface 166 can also be used by the rig controller 150 to send commands to the top drive 40 and its rotary portion 100 to perform subterranean operations. This disclosure describes various embodiments for communicating with (or controlling) the rotary portion 100 of the top drive 40 via direct connections from/to a stationary portion 120 of the top drive 40.

Figure 4:
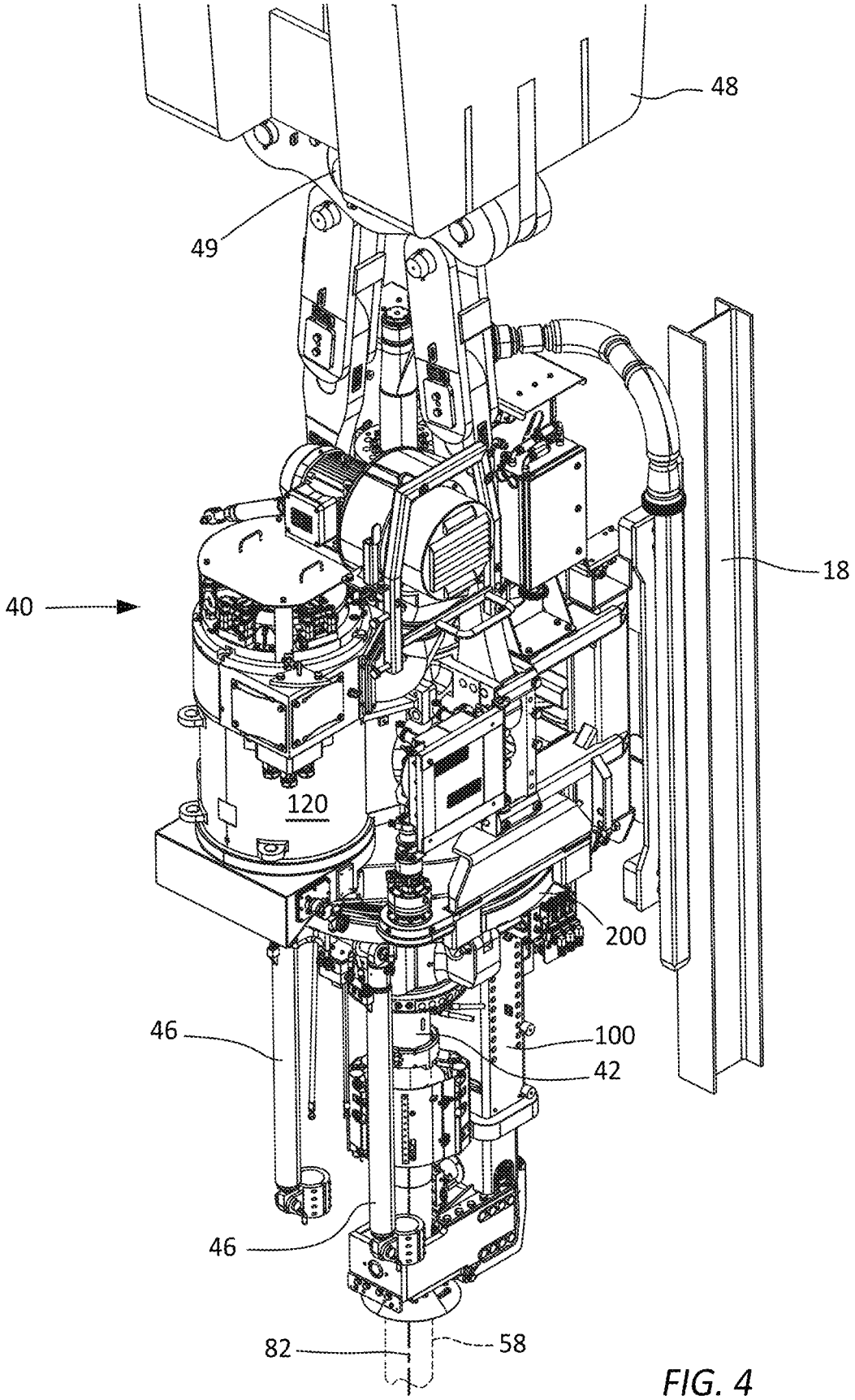
FIG. 4 is a representative isometric side view of a top drive with a drag chain assembly, in accordance with certain embodiments.

FIG. 4 is a representation isometric side view of a top drive 40 with a drag chain assembly 200, in accordance with certain embodiments. The stationary portion 120 of the top drive 40 can be slidably coupled to the guide rails 18 and translated along the guide rails 18 via a drawworks (see FIG. 9) raising and lowering a travel block 48 that can be coupled to the stationary portion 120 via the hoist support 49. The rotary portion 100 can be rotationally coupled to the stationary portion 120 and can have cables that couple the rotary portion 100 to the stationary portion 120 for transmitting signals therebetween. The cables can be fixedly coupled to the stationary portion 120 at one end and fixedly coupled to the rotary portion 100 at an opposite end.

An excess cable length can be used to allow the rotary portion 100 to rotate about the rotational axis 82 relative to the stationary portion 120 while maintaining communication through the cables between the rotary portion 100 and the stationary portion 120. The excess cable length can be managed by a drag chain assembly 200 which supports the excess cable length within a drag chain 250 (see FIGS. 11A-11C), where the drag chain feeds out or gathers back a moving portion of the drag chain 250 to accommodate the rotation of the rotary portion 100 about the rotational axis 82 relative to the stationary portion 120.

A quill 42 of the top drive 40 can be used to engage a top of the tubular string 58 and can be used to rotate the tubular string 58 about the rotational axis 82, where the quill 42 can rotate independently of the rotary portion 100, yet they both can rotate about the rotational axis 82 relative to the stationary portion 120.

Figure 5:
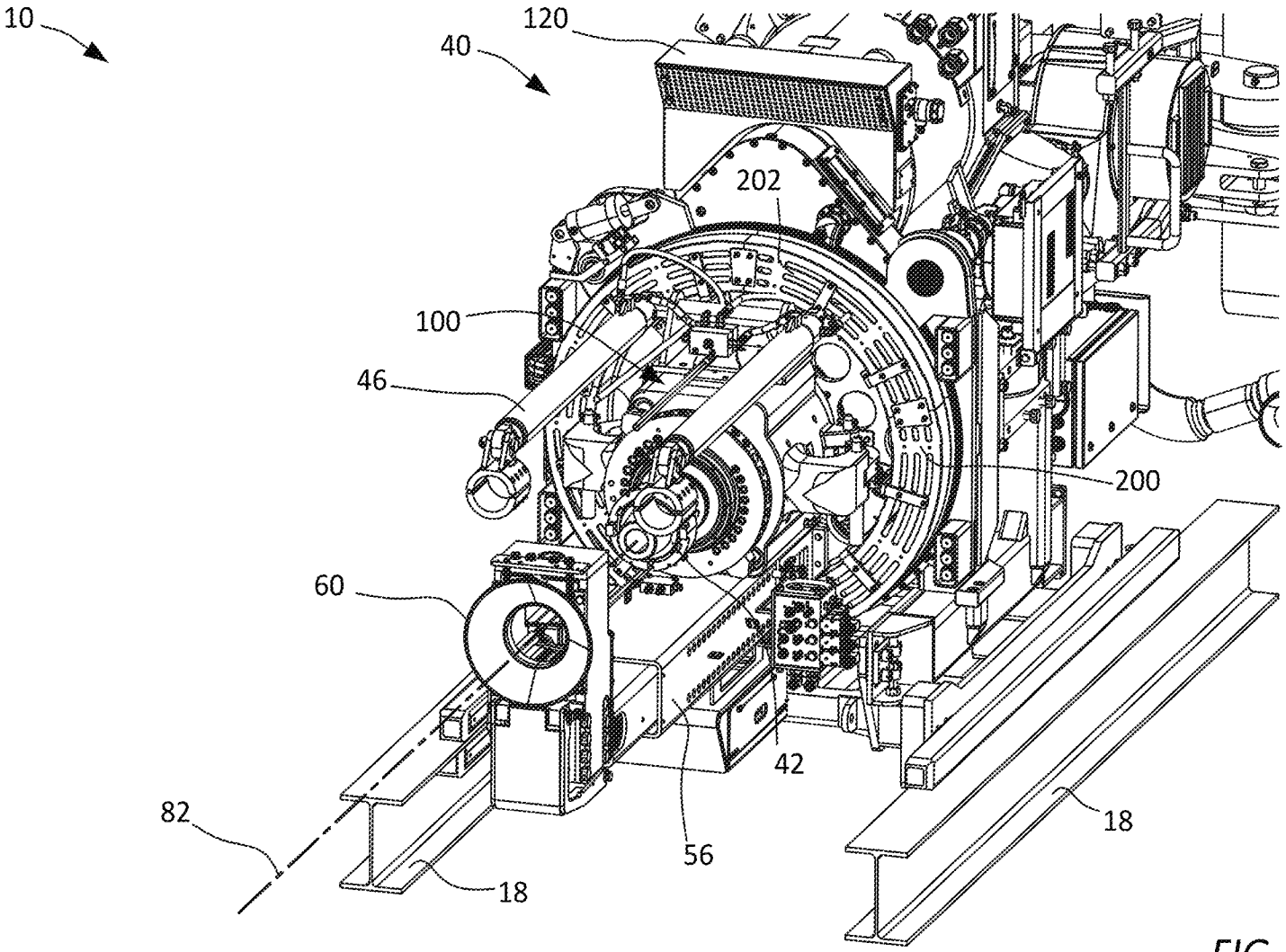
FIG. 5 is a representative isometric bottom view of a top drive with a drag chain assembly, in accordance with certain embodiments.

FIG. 5 is a representative isometric bottom view of a top drive 40 with a drag chain assembly 200, in accordance with certain embodiments. The drag chain assembly 200 can be positioned generally at the top of the rotary portion 100, and below a drive gear that is used to drive rotation of the rotary portion 100 about the rotational axis 82. The drag chain assembly 200 can be attached to a bottom surface of the drive gear 132 (see FIG. 6) and rotate with the drive gear 132. The drag chain assembly 200 can include a track 202 coupled to the bottom surface of the drive gear 132 and extending at least partially (e.g., greater than 180 degrees) around the rotational axis 82. The track 202 may not extend completely around the rotational axis 82 which can provide clearance for the backup wrench support 56 to extend downward from the drive gear 132.

Figure 6:
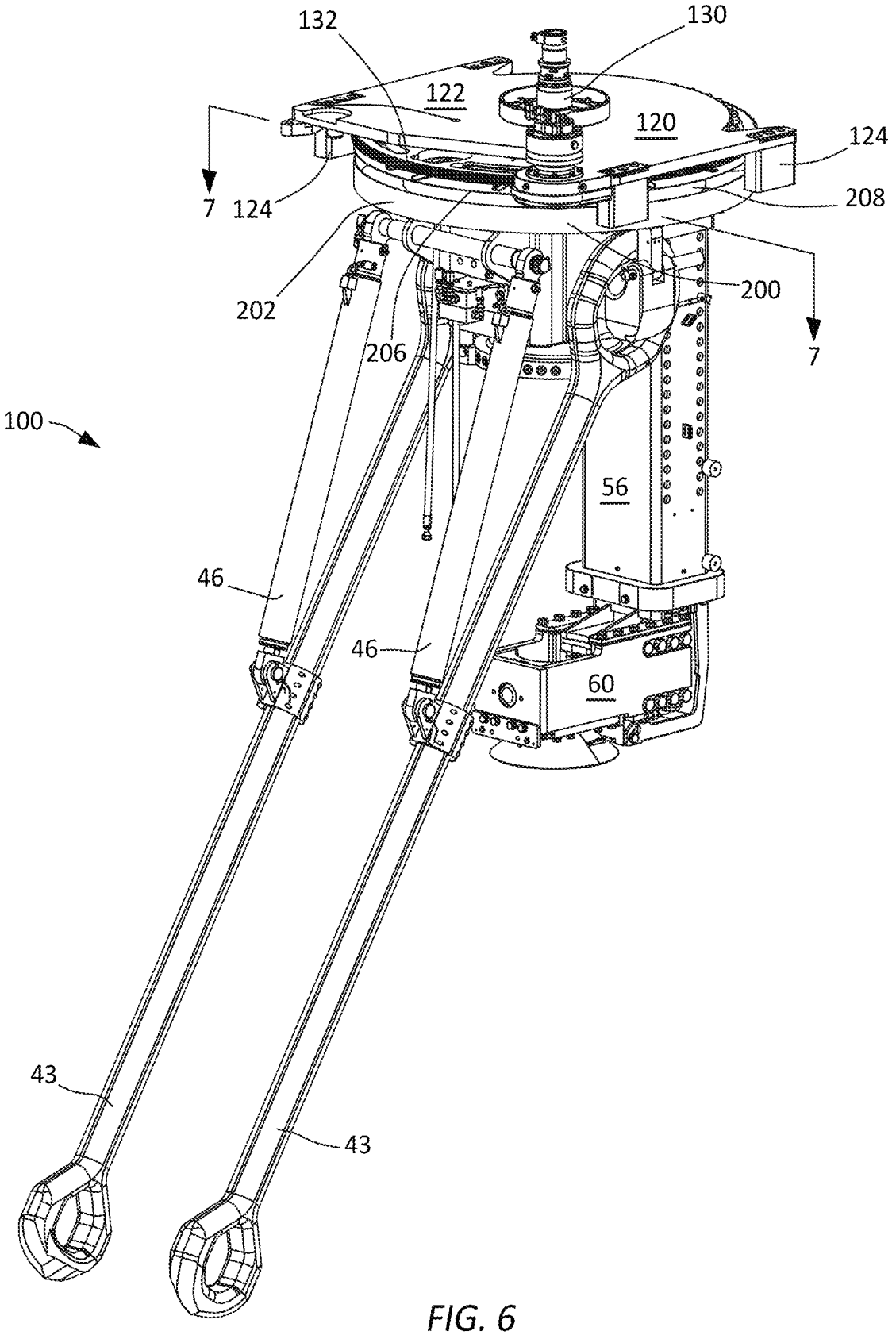
FIG. 6 is a representative isometric side view of a rotary portion of the top drive with a drag chain assembly, in accordance with certain embodiments.

FIG. 6 is a representative isometric side view of a rotary portion 100 of the top drive 40 with a drag chain assembly 200, in accordance with certain embodiments. A drive motor 130 can be fixedly mounted to a bottom plate 122 of the stationary portion 120. A drive shaft of the drive motor 130 can extend through the bottom plate 122 and engage the drive gear 132 to rotate the rotary portion 100 relative to the rotational axis 82.

The drag chain assembly 200 can include the track 202 and a shroud 206, with the track 202 positioned below the shroud 206 and forming a gap 208 therebetween. The gap 208 allows cables from the stationary portion 120 to enter the drag chain assembly 200 and travel along the gap 208 as the rotary portion 100 is rotated relative to the stationary portion 120. The track 202 can form a channel 204 (not shown, see FIG. 7) in which a drag chain 250 is positioned to manage the excess cable length of the cables coupled between the stationary portion 120 and the rotary portion 100.

Figure 7:
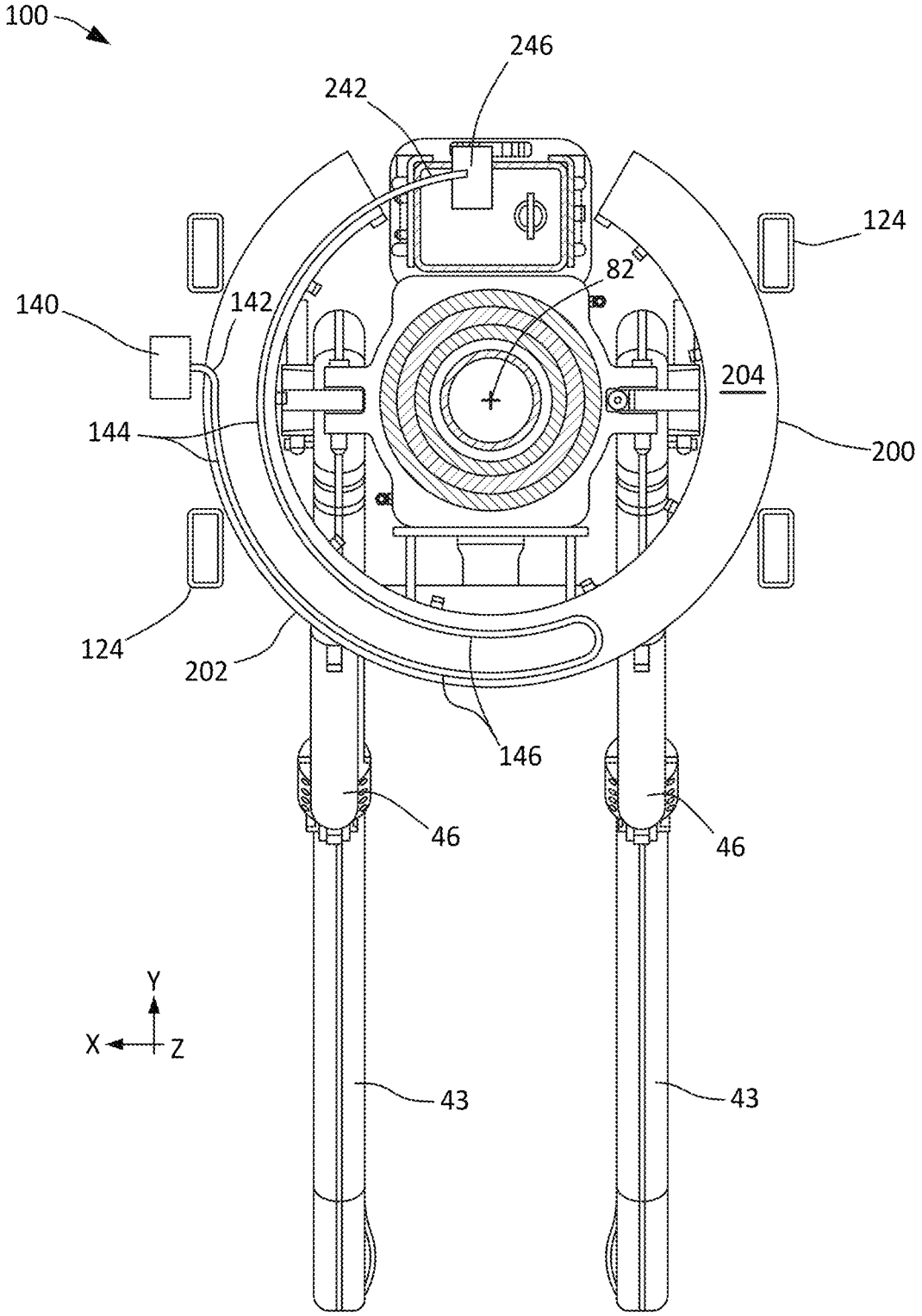
FIG. 7 is a representative partial cross-sectional view along line 7-7, as indicated in FIG. 6, of a rotary portion of the top drive with a drag chain assembly, in accordance with certain embodiments.

FIG. 7 is a representative partial cross-sectional view along line 7-7 as indicated in FIG. 6, of a rotary portion 100 of the top drive 40 with a drag chain assembly 200, in accordance with certain embodiments. The rotary portion 100 can rotate about the rotational axis 82. When the rotary portion 100 is rotated, the track 202 rotates with it and rotates relative to the lower protrusions 124 that are rotationally fixed to the stationary portion 120. As can be seen, an excess cable length of the cables 144 to be routed along the track 202. This excess cable length (which can also be referred to as a service loop) allows the rotary portion 100 to rotate relative to the stationary portion 120 while maintaining a communicative coupling between the rotary portion 100 and the stationary portion 120 via the cables 144. The path of the cables 144 from the stationary cable interface 140 and the rotary cable interface 240 can include various connections (e.g., bulkhead connections, couplings, etc.) while providing a path of communication between the rotary portion 100 and the stationary portion 120.

The cables 144 can provide one or more communication mediums for communicating signals between the rotary portion 100 and the stationary portion 120, such as hydraulic signals, electrical signals, optical signals, pressure signals, pneumatic signals, wired network signals, or combinations thereof. The cables 144 can be connected (or coupled) at one end 142 to the stationary cable interface 140 and at an opposite end 242 to various connections 246 on the rotary portion 100. The cables 144 include the ends 142, 242 as well as the middle portion 146 that couples the ends 142, 242 together. The signals can be used to monitor or control portions of the rotary portion 100.

Figure 8:
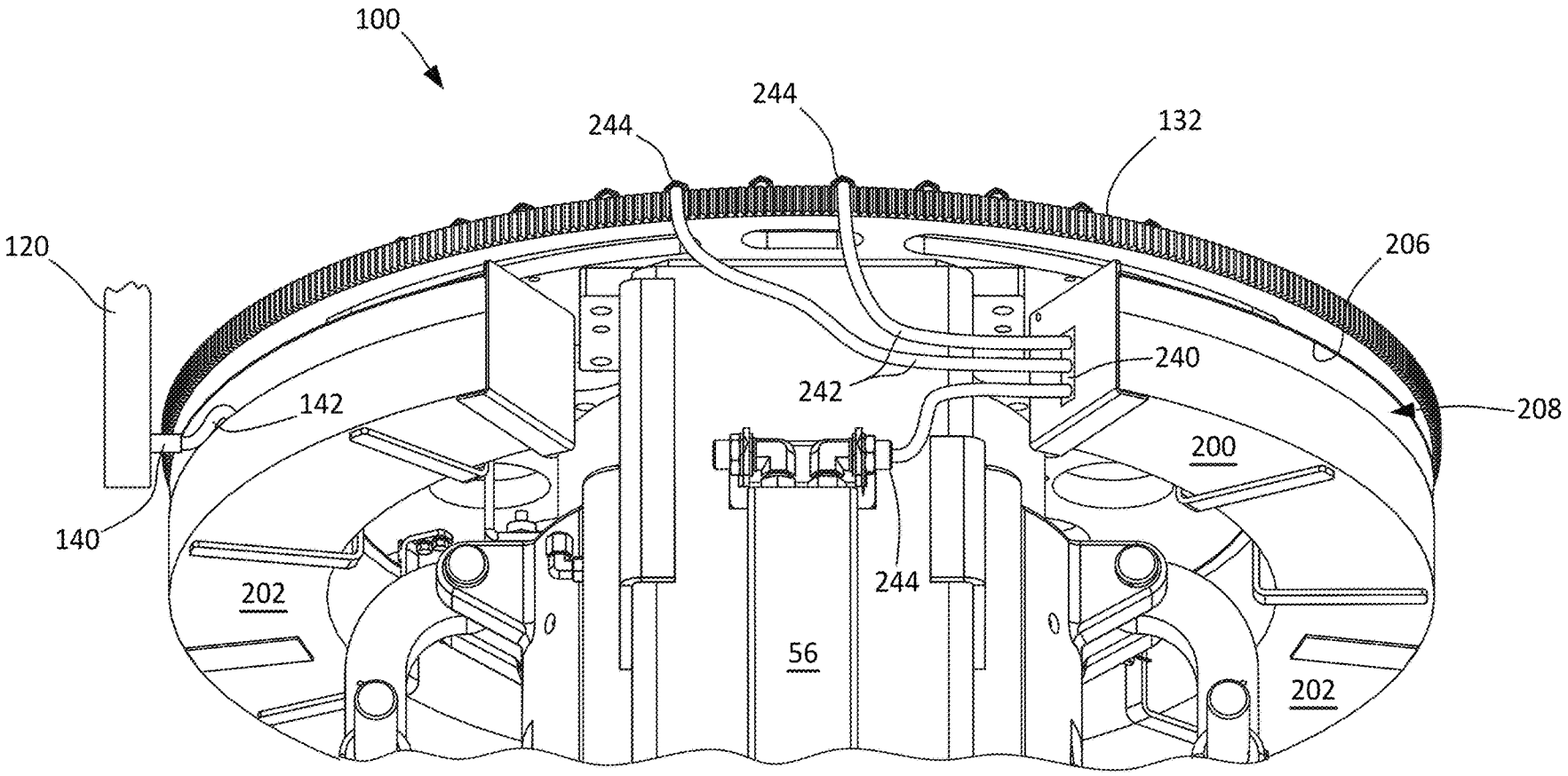
FIG. 8 is a representation isometric back view and functional diagram of a rotary portion of the top drive with a drag chain assembly, in accordance with certain embodiments.

FIG. 8 is a representation isometric back view and functional diagram of a rotary portion 100 of the top drive 40 with a drag chain assembly 200, in accordance with certain embodiments. The rotary portion 100 can be rotated about the rotational axis 82 when the drive motor 130 drives the drive gear 132 and rotates the rotary portion 100 as well as all things that are fixedly coupled to the rotary portion 100, such as a casing running tool, a link interface, a backup wrench 60, or the drag chain assembly 200.

A stationary cable interface 140 can be rotationally fixed to the stationary portion 120 and coupled to the end 142 of the cables 144, which are disposed at least partially in the drag chain assembly 200. The end 142 can extend from the stationary cable interface 140 into the drag chain assembly 200 via the gap 208 where the middle portion 146 of the cables can lay along the track 202. The other end 242 of the cables 144 can be coupled to the middle portion 146 via the rotary cable interface 240 and coupled to various connections 244 of the rotary portion 100. As can be seen, the end 142 of the cables remains stationary as the rotary portion 100 is rotated, and the end 242 of the cables 144 rotates with the rotary portion 100. The drag chain assembly 200 manages the changing amount of excess cable length as the rotary portion 100 is rotated.

Figure 9:
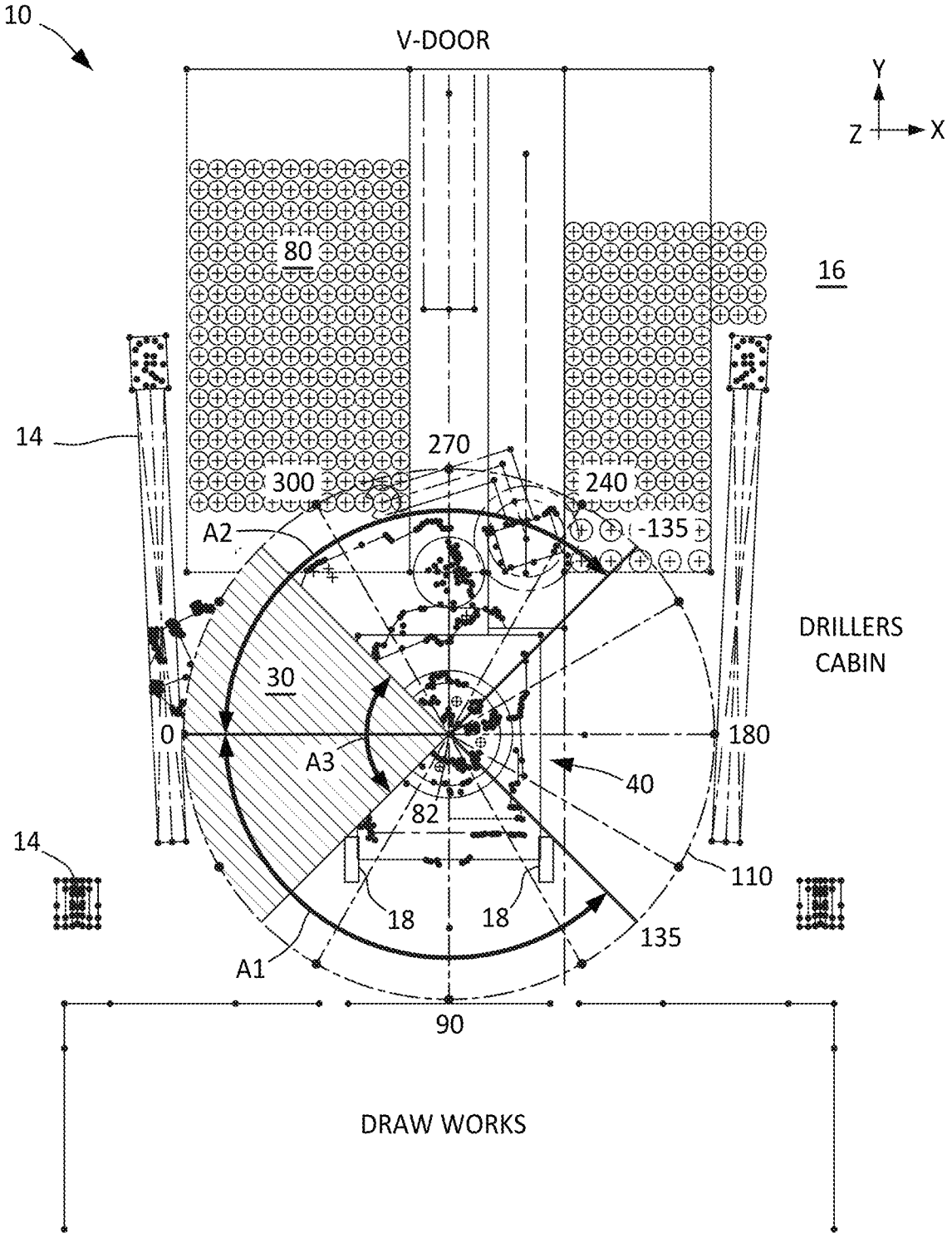
FIG. 9 is a representative partial cross-sectional top view of a rig showing a rotational keep out zone of the top drive relative to a rotational axis of the top drive, in accordance with certain embodiments.

FIG. 9 is a representative partial cross-sectional top view of a rig 10 showing a rotational keep out zone of the top drive 40 relative to a rotational axis 82, in accordance with certain embodiments. A rotational plot 110 is superimposed over a layout of rig equipment on the rig floor 16 of the rig 10. The rotational graph plots a 360 degree arc around the rotational axis 82 of the top drive 40. In a non-limiting embodiment, a keep out zone 30 can be established to indicate a portion of the rotational graph through which the top drive 40 should not rotate the links 43. It should be understood that this keep out zone can vary from rig to rig. Therefore, the keep out zone 30 for other rigs 10 can be larger or smaller than the configuration shown in FIG. 9. FIG. 9 shows a possible arc distance A3 that can be established as a keep out zone 30. In this example, the keep out zone 30 corresponds to a radial arc length A3 from "0" zero degrees to +/−45 degrees (or 90 degrees). In this example, this is the region through which the top drive 40 may be restricted from rotating the links 43 (and possible an elevator 44) into the keep out zone 30 as it rotates the rotary portion 100 about the rotational axis 82.

In the following figures, a center of the backup wrench support 56 is used to indicate the rotational position of the rotary portion 100 about the rotational plot 110. The following figures show a rotation of the backup wrench support 56, but it should be understood that the links 43 are rotated as a point in the 360 degrees circle (i.e., rotational plot 110) that is 180 degrees away from the backup wrench support 56. Therefore, the rotational plot 110 shows an angle A1 rotating the backup wrench support 56 through a range from "0" zero degrees to +135 degrees, which corresponds to a center position between the links 43 being rotated through a range from 180 degrees to 315 degrees. The rotational plot 110 shows an angle A2 rotating the backup wrench support 56 through a range from "0" zero degrees to −135 degrees, which corresponds to a center position between the links 43 being rotated through a range from 180 degrees to 45 degrees.

Therefore, rotating the backup wrench support 56 from −135 degrees to +135 degrees, rotates the center position between the links 43 from +45 degrees to +315 degrees, which keeps the center position between the links 43 generally out of the keep out zone, and thus keeps the links 43 generally out of the keep out zone 30. The azimuthal orientation of the links 43 is determined by the center position between the links 43, with the arch distance A3 being 90 degrees. The arc distance A3 restricts the center position of the links 43 from entering the keep out zone (via top drive 40 controller, such as the rig controller 150), even if one of the links 43 encroach into the keep out zone 30 and the +45 degrees or the −45 degrees azimuthal position of the center position of the links 43.

The top drive 40 is configured to move vertically along the guide rails 18. When the rotary portion 100 is rotated to an azimuthal orientation to tilt the links 43 toward the V-Door, then the backup wrench support 56 would be at an azimuthal position of 90 degrees (relative to the 360 degree scale) or plus 90 degrees (relative to the +/−180 degree scale) and the links 43 would tilt toward the V-Door at an azimuthal position of 270 degrees (relative to the 360 degree scale) or minus 90 degrees (relative to the +/−180 degree scale). This orientation of the rotary portion 100 that is shown in FIG. 10.

Figure 10:
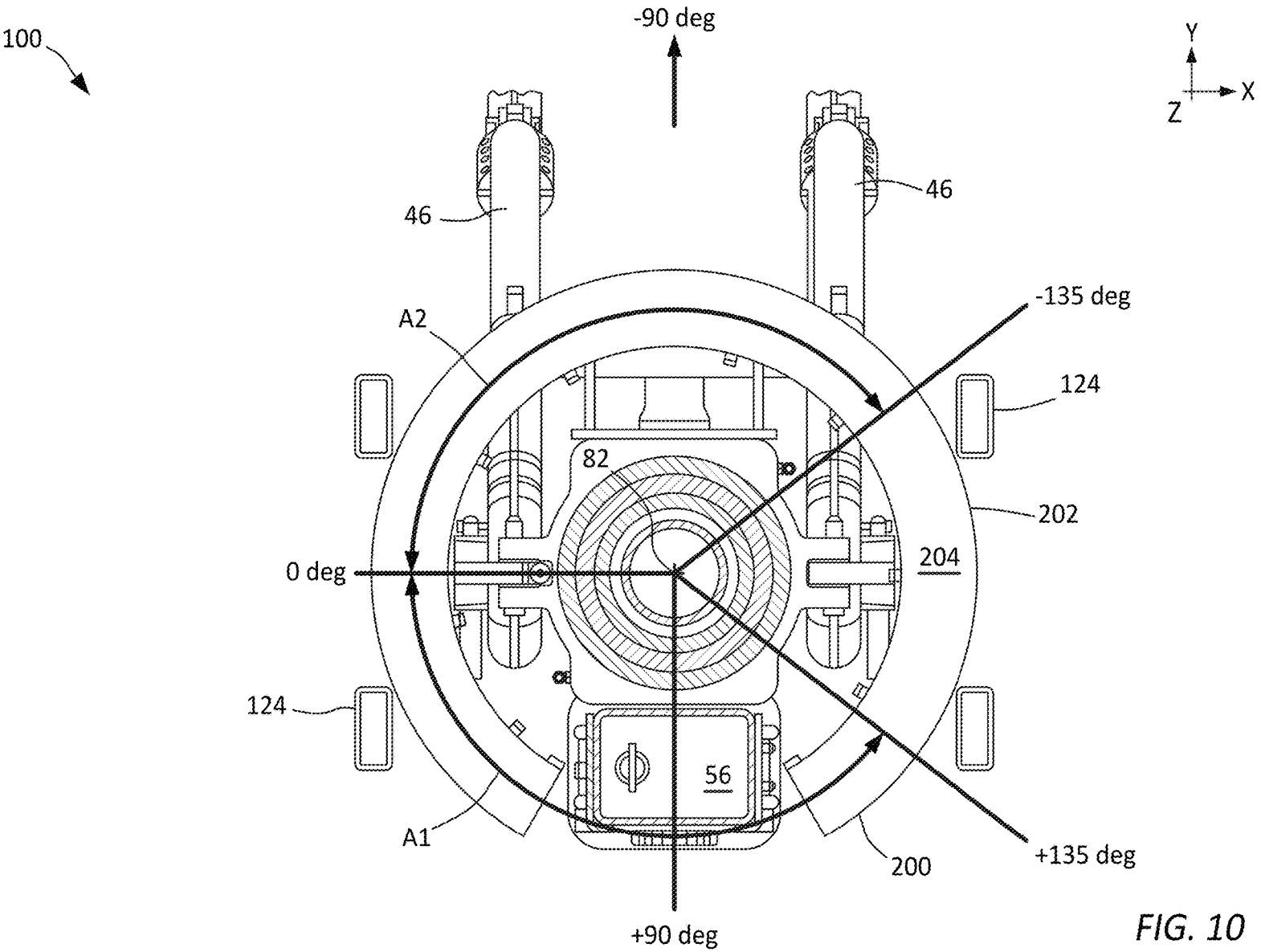
FIG. 10 is a representative partial cross-sectional top view of a rotary portion of a top drive illustrating ranges of rotational movements of the rotary portion about a rotational axis of the top drive, in accordance with certain embodiments.

FIG. 10 is a representative partial cross-sectional view along line 7-7 as indicated in FIG. 6 of a rotary portion 100 of a top drive 40 with annotations illustrating ranges of rotational movements of the rotary portion 100 about a rotational axis 82 of the top drive 40, in accordance with certain embodiments. The rotary portion 100 has been rotated relative to the stationary portion 120 (e.g., protrusions 124 rotationally fixed to the stationary portion 120) such that the backup wrench support 56 is positioned at +90 degrees, with the center position of the links 43 (or the link tilt actuators 46) being positioned at −90 degrees. The arc distances A1, A2 illustrate the rotation range of the center of the backup wrench support 56, which keeps the center position of the links 43 out of the keep out zone 30. It should be understood that other rigs 10 may have larger or smaller keep out zones 30. For example, the keep out zone could be 80 degrees with the rotary portion 100 allowed to rotate between +140 degrees to −140 degrees. In a non-limiting embodiment, the keep out zone 30 shown in FIG. 9 is 90 degrees, but this could be smaller or larger in keeping with the principles of this disclosure.

In a non-limiting embodiment, the arc distances A1, A2 can range from "0" zero degrees to +/−135 degrees about the rotational axis 82. The track 202 can include an internal channel 204 along which the excess cable length can be managed as the rotary portion 100 is rotated relative to the stationary portion 120.

Figure 11A:
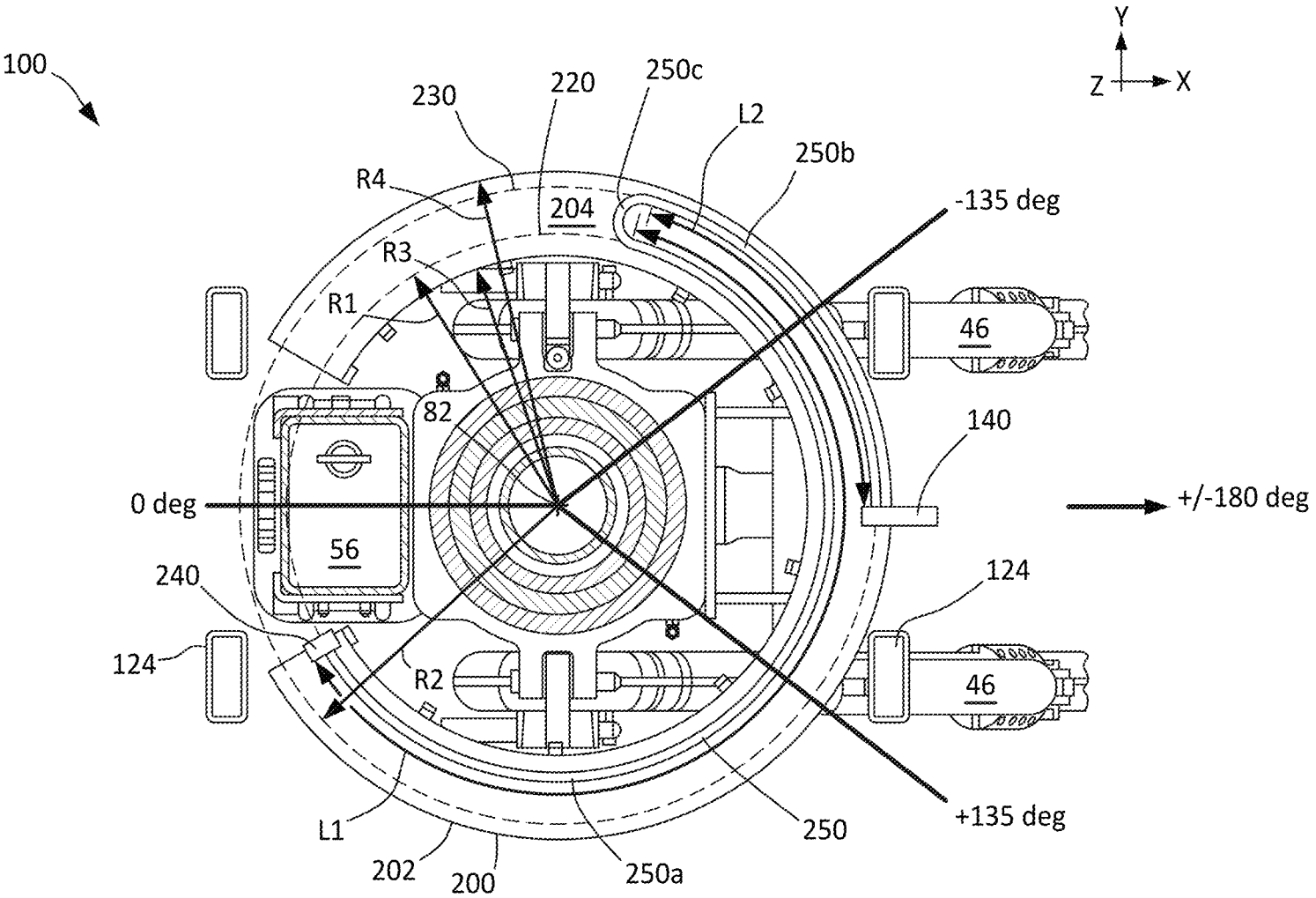
FIGS. 11A-11C are representative partial cross-sectional top views of a rotary portion of a top drive illustrating rotational movement of the rotary portion about a rotational axis of the top drive with corresponding movements of a drag chain, in accordance with certain embodiments.
Figure 11B:
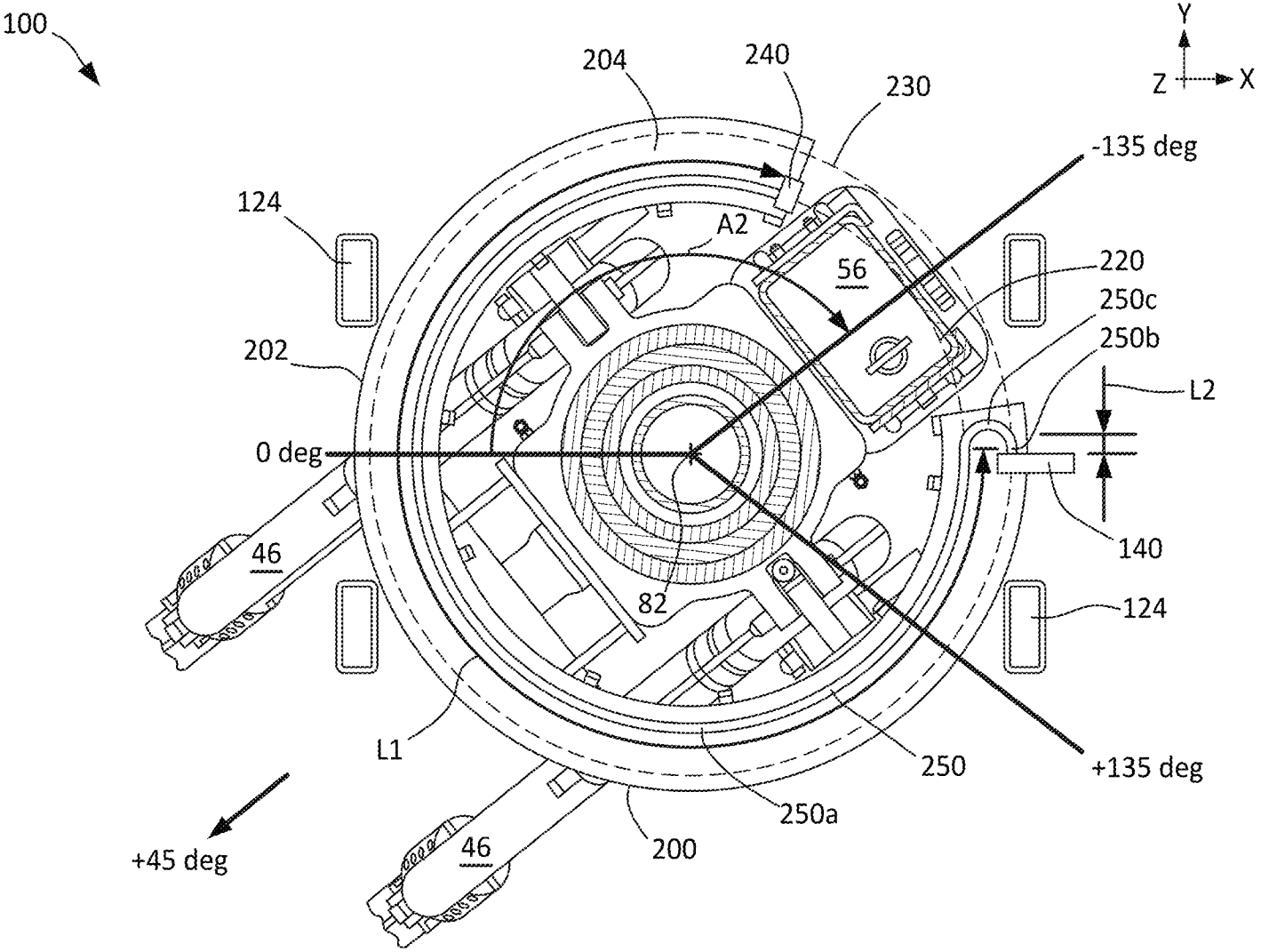
Figure 11C:
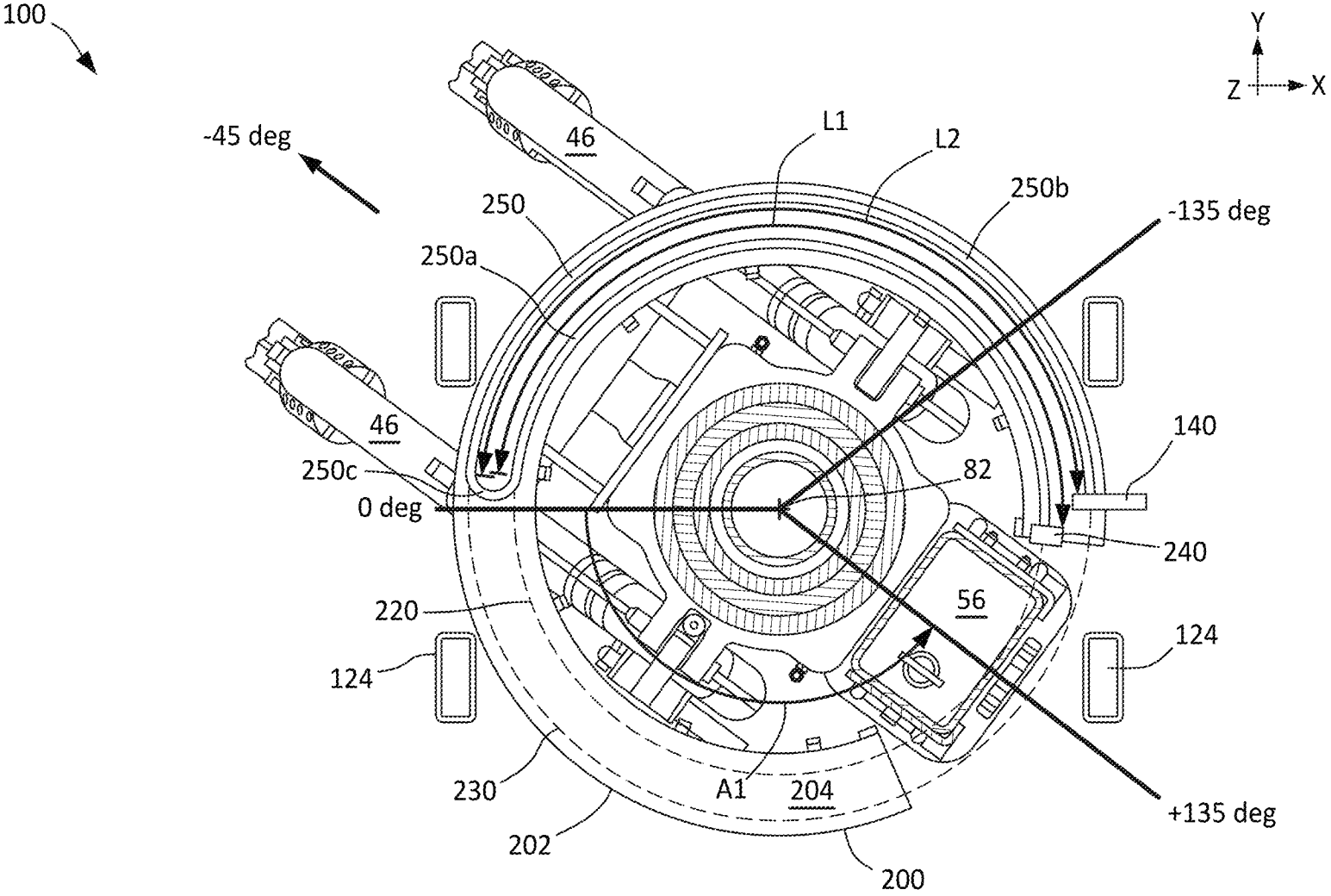

FIGS. 11A-11C are representative partial cross-sectional views along line 7-7 as indicated in FIG. 6 of a rotary portion 100 of a top drive 40 illustrating rotational movement of the rotary portion 100 about a rotational axis 82 of the top drive 40 with corresponding movements of a drag chain 250 in the drag chain assembly 200, in accordance with certain embodiments.

Referring to FIG. 11A, the rotary portion 100 has been rotated such that the center of the backup wrench support 56 is at an azimuthal position of "0" zero degrees with the center position of the links 43 (or the link tilt actuators 46) positioned at +/−180 degrees. The drag chain assembly 200 can manage the excess cable length of the cables 144 by laying the excess cable length along the channel 204 of the track 202 and dragging or pushing the excess cable length along the circular channel 204. The drag chain assembly 200 includes a drag chain 250 with a first portion 250*a*, a second portion 250*b*, and a transition portion 250*c*, where the transition portion 250*c* is defined as the portion of the drag chain 250 that couples the first portion 250*a* and the second portion 250*b* together and transitions some of the drag chain 250 between the first portion 250*a* and the second portion 250*b* as the rotary portion 100 is rotated.

The drag chain assembly 200 can organize the drag chain 250 such that the first portion 250*a* is substantially disposed along a first circular path 220 in the channel 204. The first circular path 220 has a first radius R1 relative to the rotational axis 82. The second portion 250*b* is substantially disposed along a second circular path 230 in the channel 204. The second circular path 230 has a second radius R2 relative to the rotational axis 82. The first radius R1 is preferably shorter than the second radius R2. The distance that the first portion 250*a* extends along the first circular path 220 can be referred to as an arc length L1. The distance that the second portion 250*b* extends along the second circular path 230 can be referred to as an arc length L2.

The channel 204 can have an inner radius R3 relative to the rotational axis 82 and an outer radius R4 relative to the rotational axis 82. The radii R1 and R2 are shorter than the outer radius R4 and longer than the inner radius R3.

As the rotary portion 100 is rotated, the amount of the drag chain 250 laying along the first circular path 220 (i.e., first portion 250*a*) changes and the amount of the drag chain 250 laying along the second circular path 230 (i.e., second portion 250*b*) changes in an inverse proportional to the change of the amount of the drag chain 250 laying along the first circular path 220. Therefore, the arc lengths L1 and L2 are also inversely proportional to each other. As some of the drag chain 250 is transitioned from the first portion 250*a*, through the transition portion 250*c*, to the second portion 250*b*, the arc length L1 decreases and the arc length L2 increases. Additionally, as some of the drag chain 250 is transitioned from the second portion 250*b*, through the transition portion 250*c*, to the first portion 250*a*, the arc length L1 increases and the arc length L2 decreases. As the rotary portion 100 is rotated relative to the stationary portion 120, the drag chain assembly 200 can manage the excess cable length disposed in the drag chain 250 by managing the arc lengths L1, L2 of the drag chain 250 to accommodate for the rotation of the rotary portion 100.

The first portion 250*a* and second portion 250*b* increase or decrease in length because the cables 144 are coupled at one end 142 to a stationary cable interface 140 that is rotationally fixed to the stationary portion 120 of the top drive 40. The transitioning of amounts of the drag chain between the first portion 250*a* and the second portion 250*b* allows the rotary portion 100 to rotate relative to the stationary portion 120, while maintaining a coupling of the cables 144 between the stationary portion 120 and the rotary portion 100.

FIGS. 11B, 11C illustrate the movement of the drag chain 250 as the rotary portion 100 is rotated to one limit at −135 degrees (FIG. 11B) and to the other limit at +135 degrees (FIG. 11C).

Referring to FIG. 11B, the rotary portion 100 has been rotated such that the center of the backup wrench support 56 is positioned at −135 degrees, which corresponds to the center position of the links 43 (or link tilt actuators 46) being positioned at +45 degrees. In this configuration, almost all of the drag chain 250 is positioned in the first portion 250*a* along the first circular path 220 with the arc length L1 generally at its maximum value. The drag chain 250 has been extended along the channel 204 such that only a minimal portion of the drag chain 250 remains in the second portion 250*b*. In a non-limiting embodiment, the rotary portion 100 can be restricted from rotating past the −135 degrees to prevent the center position of the links 43 (or link tilt actuators 46) from rotating past +45 degrees. At this point, any further movement of the rotary portion 100 would be counterclockwise toward "0" zero degrees, in accordance with certain embodiments.

Referring to FIG. 11C, the rotary portion 100 has been rotated such that the center of the backup wrench support 56 is positioned at +135 degrees, which corresponds to the center position of the links 43 (or link tilt actuators 46) being positioned at −45 degrees. In this configuration, the amount of the drag chain 250 positioned in the first portion 250*a* along the first circular path 220 with the arc length L1 may generally be equal (or at least close to being equal) to the amount of the drag chain 250 positioned in the second portion 250*b* along the second circular path 230 with the arc length L2. In a non-limiting embodiment, the rotary portion 100 can be restricted from rotating past +135 degrees to prevent the center position of the links 43 (or link tilt actuators 46) from rotating past −45 degrees. At this point, any further movement of the rotary portion 100 would be clockwise toward "0" zero degrees, in accordance with certain embodiments.

The drag chain assembly 200 allows the rotary portion 100 to freely rotate between the rotational limits (e.g., +/−135 degrees) to support a subterranean operation (e.g., tubular handling, tubular management, etc.) when the top drive 40 is involved in the operation.

VARIOUS EMBODIMENTS

Embodiment 1

A top drive for supporting a subterranean operation, the top drive comprising:

a stationary portion;

a rotary portion rotationally coupled to the stationary portion, the rotary portion being configured to rotate about a rotational axis;

a drag chain with a first end coupled to the stationary portion and a second end coupled to the rotary portion;

a first circular path with a first radius relative to the rotational axis; and a second circular path with a second radius relative to the rotational axis, wherein the first radius is different from the second radius, wherein the drag chain comprises a first portion that is disposed along the first circular path and a second portion that is disposed along the second circular path, and wherein a first arc length of the first portion along the first circular path increases or decreases as the rotary portion rotates relative to the stationary portion.

Embodiment 2

The top drive of embodiment 1, wherein a second arc length of the second portion along the second circular path decreases or increases as the rotary portion rotates relative to the stationary portion.

Embodiment 3

The top drive of embodiment 1, wherein the first arc length of the first portion along the first circular path increases as the rotary portion rotates in a first direction relative to the stationary portion, and wherein a second arc length of the second portion along the second circular path decreases as the rotary portion rotates in the first direction relative to the stationary portion.

Embodiment 4

The top drive of embodiment 3, wherein the first arc length of the first portion along the first circular path decreases as the rotary portion rotates in a second direction relative to the stationary portion, and wherein the second arc length of the second portion along the second circular path increases as the rotary portion rotates in the second direction relative to the stationary portion.

Embodiment 5

The top drive of embodiment 1, wherein the rotary portion is configured to rotate to any azimuthal orientation relative to the rotational axis from "0" zero degrees up to +/−140 degrees relative to the stationary portion.

Embodiment 6

The top drive of embodiment 1, wherein the rotary portion is configured to rotate to any azimuthal orientation relative to the rotational axis from "0" zero degrees up to +/−135 degrees relative to the stationary portion.

Embodiment 7

The top drive of embodiment 1, further comprising a quill configured to rotate about the rotational axis, wherein the rotary portion is configured to rotate relative to the quill and the stationary portion.

Embodiment 8

The top drive of embodiment 1, further comprising one or more cables, with at least a portion of the one or more cables disposed in the drag chain, wherein the one or more cables couple the rotary portion to the stationary portion, and wherein the one or more cables transfer signals between the rotary portion and the stationary portion.

Embodiment 9

The top drive of embodiment 8, wherein the signals comprise one of hydraulic signals, electrical signals, optical signals, pressure signals, pneumatic signals, wired network signals, or a combination thereof.

Embodiment 10

The top drive of embodiment 8, wherein the rotary portion comprises a link interface that supports a pair of links and is configured to tilt the links toward or away from the rotational axis.

Embodiment 11

The top drive of embodiment 10, wherein the rotary portion is configured to rotate to any azimuthal orientation relative to the rotational axis from "0" zero degrees up to +/−135 degrees relative to the stationary portion, and wherein the signals monitor or control operation of the link interface.

Embodiment 12

The top drive of embodiment 10, wherein the signals monitor or control a backup wrench of the rotary portion.

Embodiment 13

The top drive of embodiment 1, wherein the stationary portion is configured to be rotationally fixed to a derrick of a rig.

Embodiment 14

The top drive of embodiment 13, wherein the stationary portion is configured to be slidably coupled to the derrick.

Embodiment 15

A top drive for supporting a subterranean operation, the top drive comprising:

a stationary portion;

a rotary portion rotationally coupled to the stationary portion, the rotary portion being configured to rotate about a rotational axis;

one or more cables with a first end coupled to the stationary portion and a second end coupled to the rotary portion; and an excess length of the one or more cables disposed in a circular channel that at least partially surrounds the rotational axis, wherein the excess length of the one or more cables allows rotation of the rotary portion relative to the stationary portion while the one or more cables remain coupled between the rotary portion and the stationary portion.

Embodiment 16

The top drive of embodiment 15, wherein the excess length of the one or more cables is disposed within a drag chain that is disposed in the circular channel.

Embodiment 17

The top drive of embodiment 16, wherein the drag chain comprises a first portion disposed along a first arc length of a first circular path in the channel and a second portion disposed along a second arc length of a second circular path in the channel, and wherein the first circular path is radially spaced away from the second circular path.

Embodiment 18

The top drive of embodiment 17, wherein the first arc length increases and the second arc length decreases as the rotary portion rotates in a first direction relative to the stationary portion.

Embodiment 19

The top drive of embodiment 18, wherein the first arc length decreases and the second arc length increases as the rotary portion rotates in a second direction relative to the stationary portion.

Embodiment 20

The top drive of embodiment 15, wherein the rotary portion is configured to rotate to any azimuthal orientation relative to the rotational axis from "0" zero degrees up to +/−140 degrees relative to the stationary portion.

Embodiment 21

The top drive of embodiment 15, wherein the rotary portion is configured to rotate to any azimuthal orientation relative to the rotational axis from "0" zero degrees up to +/−135 degrees relative to the stationary portion.

Embodiment 22

The top drive of embodiment 15, further comprising a quill configured to rotate about the rotational axis, wherein the rotary portion is configured to rotate relative to the quill and the stationary portion.

Embodiment 23

The top drive of embodiment 15, wherein the one or more cables transfer signals between the rotary portion and the stationary portion.

Embodiment 24

The top drive of embodiment 23, wherein the signals comprise one of hydraulic signals, electrical signals, optical signals, pressure signals, pneumatic signals, wired network signals, or a combination thereof.

Embodiment 25

The top drive of embodiment 23, wherein the rotary portion comprises a link interface that supports a pair of links and is configured to tilt the links toward or away from the rotational axis.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

What is claimed is:

1. A top drive for supporting a subterranean operation, the top drive comprising:

a stationary portion;

a rotary portion rotationally coupled to the stationary portion, the rotary portion being configured to rotate about a rotational axis;

one or more cables with a first end coupled to the stationary portion and a second end coupled to the rotary portion; and an excess length of the one or more cables disposed in a circular channel that at least partially surrounds the rotational axis, wherein the excess length of the one or more cables allows rotation of the rotary portion relative to the stationary portion while the one or more cables remain coupled between the rotary portion and the stationary portion.

2. The top drive of claim 1, wherein the excess length of the one or more cables is disposed within a drag chain that is disposed in the circular channel.

3. The top drive of claim 2, wherein the drag chain comprises a first portion disposed along a first arc length of a first circular path in the channel and a second portion disposed along a second arc length of a second circular path in the channel, and wherein the first circular path is radially spaced away from the second circular path.

4. The top drive of claim 3, wherein the first arc length increases and the second arc length decreases as the rotary portion rotates in a first direction relative to the stationary portion.

5. The top drive of claim 4, wherein the first arc length decreases and the second arc length increases as the rotary portion rotates in a second direction relative to the stationary portion.

6. The top drive of claim 1, wherein the rotary portion is configured to rotate to any azimuthal orientation relative to the rotational axis from "0" zero degrees up to +/−140 degrees relative to the stationary portion.

7. The top drive of claim 1, further comprising a quill configured to rotate about the rotational axis, wherein the rotary portion is configured to rotate relative to the quill and the stationary portion.

8. The top drive of claim 1, wherein the one or more cables transfer signals between the rotary portion and the stationary portion.

9. The top drive of claim 8, wherein the rotary portion comprises a link interface that supports a pair of links and is configured to tilt the links toward or away from the rotational axis.

* * * * *